US009476628B2

(12) United States Patent
Potgieter

(10) Patent No.: US 9,476,628 B2
(45) Date of Patent: Oct. 25, 2016

(54) INDUSTRIAL SHELL AND TUBE HEAT EXCHANGER

(76) Inventor: Frederik Evert Potgieter, Milnerton (ZA)

( * ) Notice: Subject to any disclaimer, the term of this patent is extended or adjusted under 35 U.S.C. 154(b) by 690 days.

(21) Appl. No.: 13/809,807

(22) PCT Filed: May 30, 2011

(86) PCT No.: PCT/IB2011/052357
§ 371 (c)(1),
(2), (4) Date: Apr. 22, 2013

(87) PCT Pub. No.: WO2012/007856
PCT Pub. Date: Jan. 19, 2012

(65) Prior Publication Data

US 2013/0199216 A1 Aug. 8, 2013

(30) Foreign Application Priority Data

Jul. 12, 2010 (ZA) ..... 2010/04869

(51) Int. Cl.

| | |
|---|---|
| ***F25C 5/02*** | (2006.01) |
| ***F25C 1/14*** | (2006.01) |
| ***F28D 7/16*** | (2006.01) |
| ***F28F 5/00*** | (2006.01) |
| *F28D 21/00* | (2006.01) |

(52) U.S. Cl.
CPC ..... *F25C 1/147* (2013.01); *F28D 7/16* (2013.01); *F28F 5/00* (2013.01); *F25C 2301/002* (2013.01); *F28D 2021/0098* (2013.01); *F28F 2250/08* (2013.01)

(58) Field of Classification Search
CPC ..... F25C 1/147; F25C 1/142; F25D 16/00; F25D 17/02; F28F 9/26
USPC ..... 62/71, 354, 434; 165/104.19, 145, 159
See application file for complete search history.

(56) References Cited

U.S. PATENT DOCUMENTS

| | | | | |
|---|---|---|---|---|
| 2,005,988 | A * | 6/1935 | Brown | 208/35 |
| 5,860,471 | A * | 1/1999 | Perryment et al. | 165/170 |
| 6,434,964 | B1 * | 8/2002 | Tomiyama et al. | 62/354 |

FOREIGN PATENT DOCUMENTS

| | | |
|---|---|---|
| JP | 2003-121034 | 4/2003 |
| WO | WO-2004/046624 | 6/2004 |

OTHER PUBLICATIONS

International Search Report for PCT/IB2011/052357 Dated Sep. 15, 2011.

* cited by examiner

*Primary Examiner* — Melvin Jones
(74) *Attorney, Agent, or Firm* — Stephen J. Weyer, Esq.; Stites & Harbison, PLLC

(57) ABSTRACT

The invention discloses an industrial shell and tube heat exchanger for providing freezing or chilling of brine to produce slurry ice, which includes a shell and tube heat exchanger located in a horizontal position and which includes at least one tube within the shell and tube heat exchanger; and at least one rotatable spiral driven in at least the one tube, and which is adapted to move or pump the brine and slurry ice through the respective tube to ensure individual supply of brine for the production of slurry ice.

26 Claims, 5 Drawing Sheets

View On A

Tube Arrangement

Tube Arrangement

INDUSTRIAL SHELL AND TUBE HEAT EXCHANGER

FIELD OF INVENTION

The present invention relates to an industrial shell and tube heat exchanger.

More particularly, the present invention relates to an industrial shell and tube heat exchanger for producing slurry ice with a rotating spiral in the tube mechanism.

BACKGROUND TO INVENTION

According to the Internet, slurry ice is a phase changing refrigerant made up of millions of ice "micro-crystals" (generally 0.1 to 1 mm in diameter) formed and suspended within a solution of water and a freezing point depressant. Some compounds used in the field are salt (sodium chloride), ethylene glycol, propylene glycol, various alcohols (Isobutyl, ethanol) and sugar (sucrose, glucose). Slurry Ice has greater heat absorption compared with single phase refrigerants (Brine) because the melting enthalpy (latent heat) of the ice is also used. Flow-Ice™ is a trade name for slurry ice. Flow-Ice™ is made with a heat exchanger.

The small ice particle size of slurry ice results in greater heat transfer area than other types of ice for a given weight. It can be packed inside a container as dense as 700 kg/m3, the highest ice-packing factor among all usable industrial ice. The spherical crystals have good flow properties, making them easy to distribute through conventional pumps and piping and over product in direct contact chilling applications, allowing them to flow into crevices and provide greater surface contact and faster cooling than other traditional forms of ice.

Its flow properties, high cooling capacity and flexibility in application make a slurry ice system a substitute for conventional ice generators and refrigeration systems, and offers improvements in efficiency: energy efficiency of 70%, compared to around 45% in standard systems, lower freon consumption per ton of ice and lower operating costs.

Slurry ice is commonly used in a wide range of air conditioning, packaging, and industrial cooling processes, supermarkets, and cooling and storage of fish, produce, poultry and other perishable products.

Conventional current slurry ice producing technologies include the following:

(a) Orbital Rod Tube Whip Heat Exchanger

Orbital rod tube heat exchanger include a rod which rotates centrifugally in each tube of a vertical shell and tube heat exchanger, and a film of brine drains down the tube by gravity and carry the ice created down to exit the heat exchanger. The orbital rod induces the heat transfer. This technology has a drive plate to drive a multiple of rods hanging from the top and has the tendency to vibrate and does not suit needs in terms of robust operation. This technology is more suited for thermal energy storage where all fluids and conditions are designed for the operation.

(b) Flat Plate Heat Exchanger

The flat plate heat exchanger is more robust in operation, but will not cover the full scope of slurry ice needs, and the capacity is too small for larger applications. The flat plate heat exchanger is also very costly to manufacture and requires a refrigerant pump, pressure vessels and controls that further increase the cost, making the system too expensive. The general operation is wipers wiping both sides of a flat plate or multiples of flat plates mounted parallel with each other and the drive shaft of the wipers drives through the centre of the plates to wipe the static plates removing the crystals forming on the surface with refrigerant in the flat plate channels.

(c) Scraped Surface Heat Exchangers

This type of heat exchanger is too small and also too costly to upscale to larger systems. It is based on a larger diameter tube with thicker walls reducing the heat transfer rate. The scraping mechanism is very costly to manufacture and the system requires a carefully designed system to make it successful in operation. The basic operation is based on a double tube heat exchanger with the refrigerant circulated through the jacket and the brine though the inner tube. The ice crystals are formed on the inner tube surface and scraped of with a scrapers or wipers and transported out with a pump pushing the brine or slurry ice.

It is an object of the invention to suggest a industrial shell and tube heat exchanger, which will assist in overcoming these problems.

SUMMARY OF INVENTION

According to the invention, an industrial shell and tube heat exchanger for providing freezing or chilling of brine to produce slurry ice, includes a shell and tube heat exchanger located in a horizontal position and which includes (a) At least one tube within the shell and tube heat exchanger; and (b) At least one rotatable spiral driven in at least one tube, and which is adapted to move or pump the brine and slurry ice through the respective tube to ensure individual supply of brine for the production of slurry ice.

Also according to the invention, a method of producing slurry ice, includes the steps of providing an industrial shell and tube heat exchanger located in a horizontal position and which includes at least one tube within the shell and tube heat exchanger; and at least one rotatable spiral driven in at least one tube, and which is adapted to move or pump the brine and slurry ice through the respective tube to ensure individual supply of brine for the production of slurry ice.

Yet further according to the invention, a method of producing slurry ice, includes the steps of moving or pumping brine and slurry ice through at least one tube to ensure individual supply of brine for the production of slurry ice.

The tubes outer surface on the refrigerant (shell side) of the tubes may be specially prepared.

The tubes may be fixed in the end plate of the shell and tube heat exchanger.

The spirals may be driven inside the tube by mechanical means.

The heat exchanger may include a mechanical drive adapted to drive the spirals and which may be aligned with the centre of the tube and fitted with bearings and shaft seal.

The mechanical drive may be directly connected to a motor and/or in bundles where the centre tube spiral drive provides the driving pulley for other tube spirals around.

The mechanical drive may be operated with belts to an arrangement of tubes around the centre tube spiral.

There may be no bearings in the opposite side of the spirals.

The spirals may self centre in the tube with the rotation.

The mechanical drive may also be done with an arrangement of gears and each gear drives a shaft supported by acetal water lubricated bearings able to drive inside the water.

All the gears mesh and balanced loads may ensure easy rotation and the centre drive exist through a shaft seal to be driven by a single geared motor.

The non drive end of the spirals may be tensioned in order to facilitate stability in the spiral operation.

The brine may provide the lubrication and dampening effect of the spiral inside the tube.

The brine may be fully flooded and circulated through the heat exchanger tubes.

Ammonia may be evaporated in the shell side and absorbs the heat from the brine in order to create ice crystals on the inner tube surface inside the brine stream.

The spirals may provide high velocity brine stream on the inner tube surface to provide best heat transfer.

The spirals may remove the ice crystals from the inner tube surface with high velocity brine stream created by the rotation of the spiral.

The spirals may provide agitation to the brine stream inside the tube and facilitate a super cooling effect, where brine is super cooled and ice crystals forms inside the brine stream.

The spirals may provide sufficient vibration in the tube to facilitate the removal of ice crystals from the inner tube surface.

The spirals may provide sufficient vibration to improve heat transfer on the refrigerant side with specially prepared surface on the outside of the tube.

The inner tube surface may be prepared to facilitate the removal of ice crystals.

The overall flow rate may be controlled with a pump to ensure the ice concentration required.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
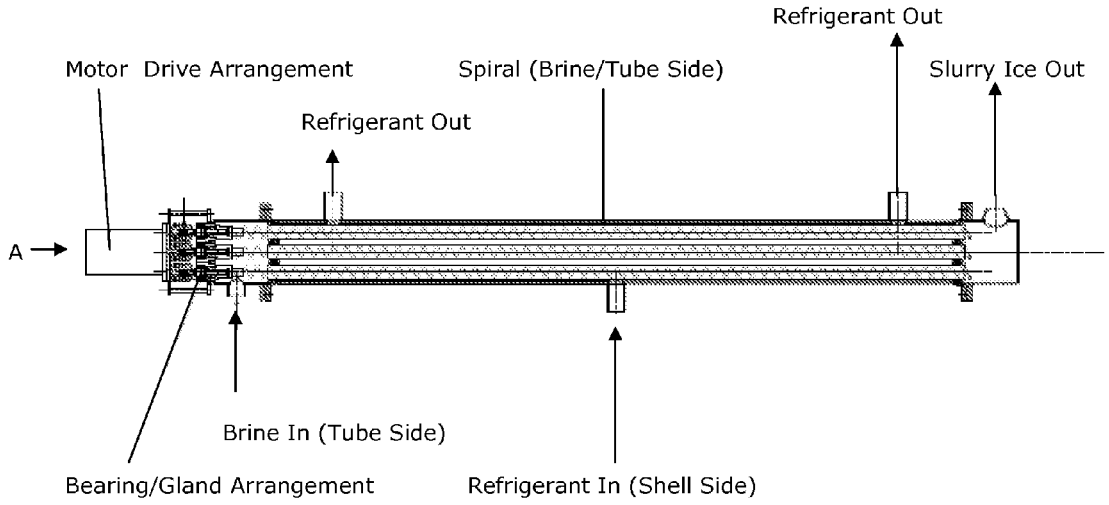
FIG. 1: Sectional side view of an industrial shell and tube heat exchanger in accordance with a first embodiment of the invention.
Figure 2:
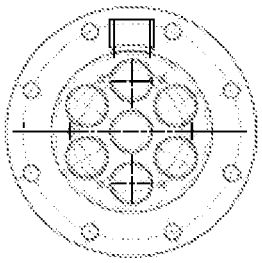
FIG. 2: Front view of the industrial shell and tube heat exchanger shown in FIG. 1 as seen from arrow A.
Figure 3:
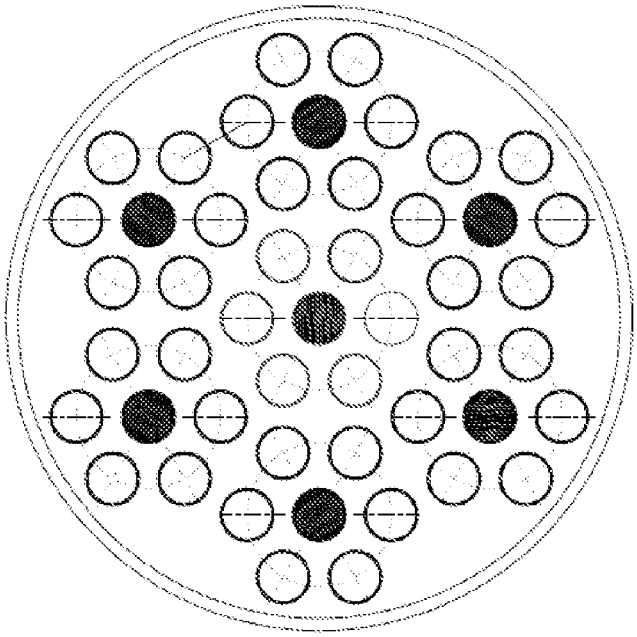
FIG. 3: Enlarged front view of tubes of the industrial shell and tube heat exchanger as seen in FIG. 2.

Referring to FIGS. 1 to 3, an industrial shell and tube heat exchanger for providing freezing or chilling of brine to produce slurry ice in accordance with a first embodiment of the invention is shown.

The industrial shell and tube heat exchanger for providing freezing or chilling of brine to produce slurry ice, includes a shell and tube heat exchanger located in a horizontal position and which includes (a) At least one tube within the shell and tube heat exchanger; and (b) At least one rotatable spiral driven in at least one tube, and which is adapted to move or pump the brine and slurry ice through the respective tube to ensure individual supply of brine for the production of slurry ice.

The tubes outer surface on the refrigerant (shell side) of the tubes are specially prepared.

The tubes are fixed in the end plate of the shell and tube heat exchanger.

The spirals are driven inside the tube by mechanical means.

The heat exchanger includes a mechanical drive adapted to drive the spirals and which may be aligned with the centre of the tube and fitted with bearings and shaft seal.

The mechanical drive is directly connected to a motor, or in bundles where the centre tube spiral drive provides the driving pulley for other tube spirals around.

The drive is done with belts to an arrangement of tubes around the centre tube spiral.

There are no bearings in the opposite side of the spirals.

The spirals self centre in the tube with the rotation.

Figure 4:
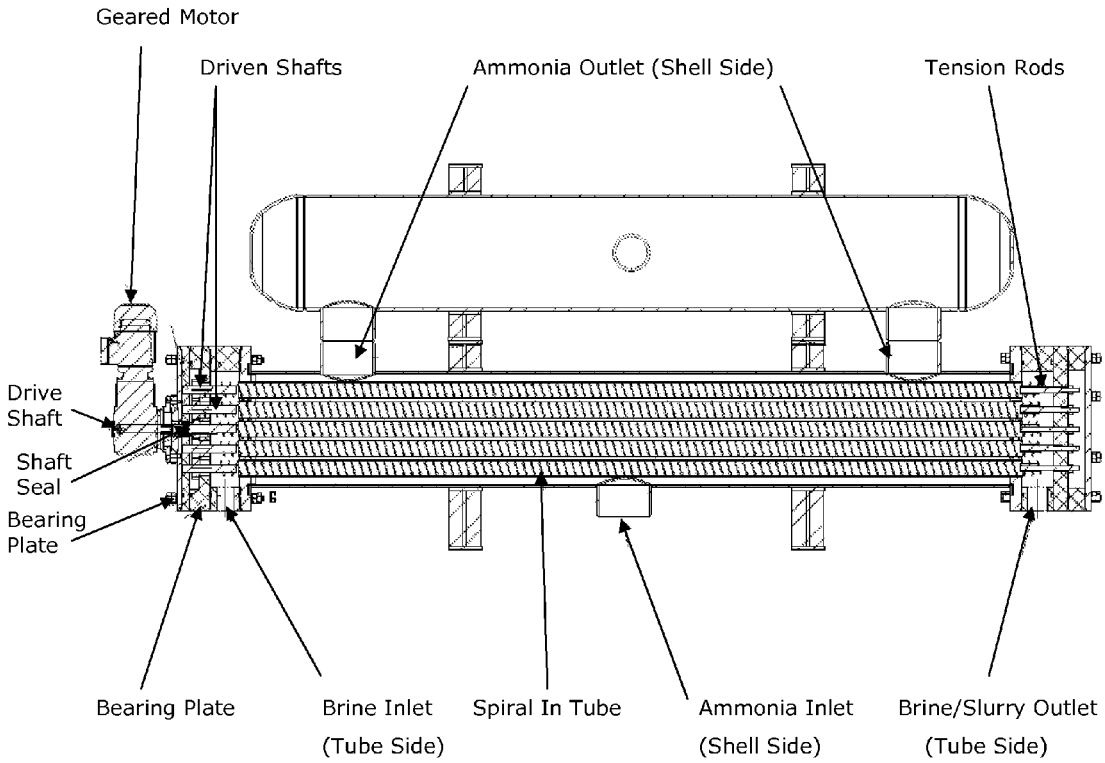
FIG. 4: Sectional side view of an industrial shell and tube heat exchanger in accordance with a second embodiment of the invention providing an alternative method to drive the spirals with gears inside the water and a single external geared motor outside the water driving the centre gear through a shaft seal assembly.
Figure 5:
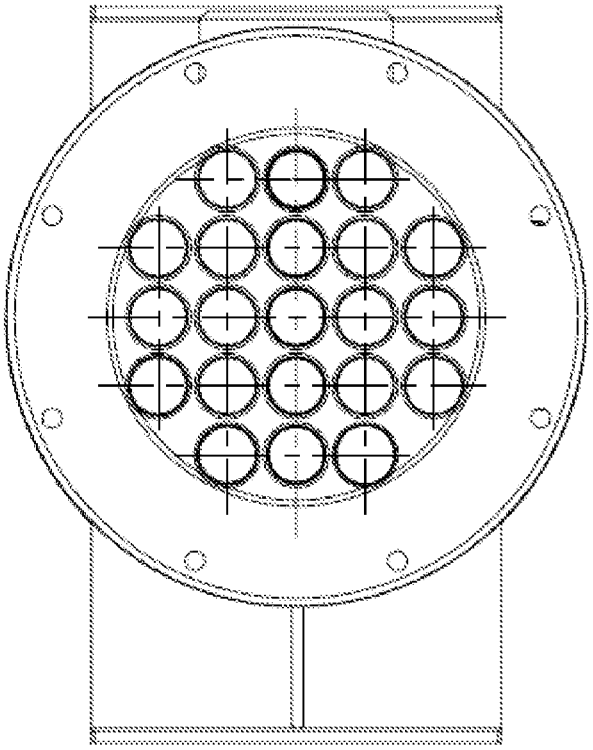
FIG. 5: Enlarged front view of tubes of the industrial shell and tube heat exchanger as seen in FIG. 4.

FIGS. 4 and 5 show an industrial shell and tube heat exchanger for providing freezing or chilling of brine to produce slurry ice in accordance with a second embodiment of the invention. In this embodiment the mechanical drive is done with an arrangement of gears and each gear drives a shaft supported by acetal water lubricated bearings, able to drive inside the water. All the gears mesh and balanced loads ensure easy rotation and the centre drive exist through a shaft seal to be driven by a single geared motor.

The non drive end of the spirals can be tensioned in order to facilitate stability in the spiral operation.

The drive method shown in FIG. 4 has a more compact arrangement to allow more tubes in the same shell. The diving loads on the gears and shaft is more balanced and therefore ensures lower friction and lower power consumption.

The brine provides the lubrication and dampening effect of the spiral inside the tube.

The brine is fully flooded and circulated through the heat exchanger tubes.

Ammonia is evaporated in the shell side and absorbs the heat from the brine in order to create ice crystals on the inner tube surface inside the brine stream.

The spirals provide high velocity brine stream on the inner tube surface to provide best heat transfer.

The spirals remove the ice crystals from the inner tube surface with high velocity brine stream created by the rotation of the spiral.

The spirals provide agitation to the brine stream inside the tube and facilitate a super cooling effect, where brine is super cooled and ice crystals forms inside the brine stream.

The spirals provide sufficient vibration in the tube to facilitate the removal of ice crystals from the inner tube surface.

The spirals provide sufficient vibration to improve heat transfer on the refrigerant side with specially prepared surface on the outside of the tube.

The inner tube surface is prepared to facilitate the removal of ice crystals.

Each tube spiral moves or pumps the brine and slurry ice through the respective tube and ensure individual supply of brine for the production of slurry ice.

The overall flow rate is controlled with a pump to ensure the ice concentration required.

The shell and tube heat exchanger in accordance with the invention is designed to produce slurry ice from a brine or any temperature depressant like salt water, sea water, ethanol, glycol etc, from now on called "brine".

Brine is flooded through the tube and ammonia provides the refrigeration outside the tube on the shell side.

A drive mechanism with bearings and shaft seal drive the spiral inside the tube.

The spiral is large enough in diameter to fit loosely in the tube, but with a tolerance close enough to touch the tube inner wall evenly when rotating.

The spiral drive is therefore positioned in the centre of the tube.

Each tube and spiral has its own drive and can be driven in different ways.

For large industrial applications, there are bundles of tubes driven with a single motor and belt drive multiple spirals from the centre.

The brine is flooded in the tubes of the heat exchanger and ice crystal forms inside the tube.

Each tube spiral transports the brine and slurry ice crystals through the tube to exit the heat exchanger.

A pump could also be used to control the flow rate through the heat exchanger in order to control the slurry ice concentration.

The applications for this heat exchanger varies from fishing, energy storage, food processing, water treatment, desalination and any application where slurry ice can be used as a secondary refrigerant.

The rotating spiral in tube shell and tube heat exchanger in accordance with the invention has the following advantages compared to the different known technologies:

(a) Lower manufacturing cost making the unit more cost effective;
(b) More suitable to upscale the system to large capacities
(c) More robust in design and operation;
(d) More versatile over the full range of applications for this technology;
(e) Is not dependent of any ancillary equipment or fluids to facilitate successful operation i.e. thermal storage tanks, special brine fluids etc.;
(f) The heat exchanger is stand alone and complete with pressure vessel and controls, compared to other equipment required pumps, pressure vessels construction frames to make the low pressure side complete.

The invention claimed is:

1. An industrial shell and tube heat exchanger for providing freezing or chilling of brine to produce slurry ice, which includes a shell and tube heat exchanger located in a horizontal position and which includes (a) at least one tube within the shell and tube heat exchanger; and
(b) at least one rotatable spiral driven in at least the one tube, and which is adapted to move or pump the brine and slurry ice through the respective tube to ensure individual supply of brine for the production of slurry ice.

2. The exchanger as claimed in claim 1, in which one of the at least one tube is fixed in an end plate of the shell and tube heat exchanger.

3. The exchanger as claimed in claim 1, in which at least one of the at least one rotatable spiral is driven inside the tube by mechanical means.

4. The exchanger as claimed in claim 1, which includes a mechanical drive adapted to drive the at least one spiral and which is aligned with the centre of the tube and fitted with bearings and shaft seal.

5. The exchanger as claimed in claim 1, which includes no bearings in the opposite side of the at least one spiral.

6. The exchanger as claimed in claim 1, in which the at least one spiral is self-centred in the tube with the rotation.

7. The exchanger as claimed in claim 1, in which the spiral is tensioned to facilitate stability in spiral operation.

8. The exchanger as claimed in claim 1, in which the brine provides the lubrication and dampening effect of the spiral inside the tube.

9. The exchanger as claimed in claim 1, which is adapted to allow ammonia to be evaporated in the shell side and which absorbs the heat from the brine in order to create ice crystals on the inner tube surface inside the brine stream.

10. The exchanger as claimed in claim 1, in which the at least one spiral is adapted to provide high velocity brine stream on the inner tube surface to provide best heat transfer.

11. The exchanger as claimed in claim 9, in which the at least one spiral is adapted to remove the ice crystals from the inner tube surface with high velocity brine stream created by the rotation of the at least one spiral.

12. The exchanger as claimed in claim 9, in which the at least one spiral is adapted to provide agitation to the brine stream inside the tube and facilitate a super cooling effect, where brine is super cooled and ice crystals forms inside the brine stream.

13. The exchanger as claimed in claim 9, in which the at least one spiral provides sufficient vibration in the tube to facilitate the removal of ice crystals from an inner surface of the tube.

14. The exchanger as claimed in claim 1, in which the at least one spiral is adapted to provide sufficient vibration to improve heat transfer on a refrigerant side with specially prepared surface on the outside of the tube.

15. The exchanger as claimed in claim 1, in which the inner surface of the tube is prepared to facilitate the removal of ice crystals.

16. The exchanger as claimed in claim 1, in which the overall flow rate is controlled with a pump to ensure the ice concentration required.

17. A method of producing slurry ice, which includes the steps of moving or pumping brine and slurry ice through at least one tube to ensure individual supply of brine for the production of slurry ice.

18. The method as claimed in claim 17, in which the tubes are fixed in the end plate of the shell and tube heat exchanger.

19. The method as claimed in claim 17, which includes the step of driving spirals inside the tube by mechanical means.

20. The method as claimed in claim 17, in which the at least one spiral provides sufficient vibration in the tube to facilitate the removal of ice crystals from the inner tube surface.

21. An industrial shell and tube heat exchanger for providing freezing or chilling of brine to produce slurry ice, which includes a shell and tube heat exchanger located in a horizontal position and which includes:

(a) at least one tube within the shell and tube heat exchanger; and
(b) at least one rotatable spiral driven in at least the one tube, and which is adapted to move or pump the brine and slurry ice through the respective tube to ensure individual supply of brine for the production of slurry ice, wherein the brine provides the lubrication and dampening effect of the at least one spiral inside the tube.

22. An industrial shell and tube heat exchanger for providing freezing or chilling of brine to produce slurry ice, which includes a shell and tube heat exchanger located in a horizontal position and which includes:

(a) at least one tube within the shell and tube heat exchanger; and (b) at least one rotatable spiral driven in at least the one tube, and which is adapted to move or pump the brine and slurry ice through the respective tube to ensure individual supply of brine for the production of slurry ice, wherein the heat exchanger is adapted to allow ammonia to be evaporated in a shell side and which absorbs the heat from the brine in order to create ice crystals on the inner tube surface inside the brine stream.

23. An industrial shell and tube heat exchanger for providing freezing or chilling of brine to produce slurry ice, which includes a shell and tube heat exchanger located in a horizontal position and which includes:

(a) at least one tube within the shell and tube heat exchanger; and (b) at least one rotatable spiral driven in at least the one tube, and which is adapted to move or pump the brine and slurry ice through the respective tube to ensure individual supply of brine for the production of slurry ice, wherein the at least one spiral is adapted to provide high velocity brine stream on the inner tube surface to provide best heat transfer.

24. An industrial shell and tube heat exchanger for providing freezing or chilling of brine to produce slurry ice, which includes a shell and tube heat exchanger located in a horizontal position and which includes:

(a) at least one tube within the shell and tube heat exchanger; and (b) at least one rotatable spiral driven in at least the one tube, and which is adapted to move or pump the brine and slurry ice through the respective tube to ensure individual supply of brine for the production of slurry ice, wherein the at least one spiral is adapted to provide sufficient vibration to improve heat transfer on a refrigerant side with specially prepared surface on the outside of the tube.

25. An industrial shell and tube heat exchanger for providing freezing or chilling of brine to produce slurry ice, which includes a shell and tube heat exchanger located in a horizontal position and which includes:

(a) at least one tube within the shell and tube heat exchanger, an inner surface of the tube being prepared to facilitate the removal of ice crystals; and (b) at least one rotatable spiral driven in at least the one tube, and which is adapted to move or pump the brine and slurry ice through the respective tube to ensure individual supply of brine for the production of slurry ice.

26. An industrial shell and tube heat exchanger for providing freezing or chilling of brine to produce slurry ice, which includes a shell and tube heat exchanger located in a horizontal position and which includes:

(a) at least one tube within the shell and tube heat exchanger; and (b) at least one rotatable spiral driven in at least the one tube, and which is adapted to move or pump the brine and slurry ice through the respective tube to ensure individual supply of brine for the production of slurry ice, wherein an overall flow rate is controlled with a pump to ensure an ice concentration required.

* * * * *